US010654636B2

(12) United States Patent
Furuse et al.

(10) Patent No.: US 10,654,636 B2
(45) Date of Patent: May 19, 2020

(54) PAPER LID AND STORAGE CONTAINER

(71) Applicant: LOTTE CO., LTD., Shinjuku-ku, Tokyo (JP)

(72) Inventors: Kiyoto Furuse, Tokyo (JP); Kenji Toyama, Tokyo (JP); Junpei Omura, Tokyo (JP); Makoto Yamaguchi, Tokyo (JP); Naoko Kobayashi, Tokyo (JP); Yuka Shibata, Saitama (JP)

(73) Assignee: Lotte Co., Ltd., Tokyo (JP)

( * ) Notice: Subject to any disclaimer, the term of this patent is extended or adjusted under 35 U.S.C. 154(b) by 0 days.

(21) Appl. No.: 16/068,385

(22) PCT Filed: Dec. 27, 2016

(86) PCT No.: PCT/JP2016/088882
§ 371 (c)(1),
(2) Date: Jul. 6, 2018

(87) PCT Pub. No.: WO2017/119360
PCT Pub. Date: Jul. 13, 2017

(65) Prior Publication Data

US 2019/0023471 A1 Jan. 24, 2019

(30) Foreign Application Priority Data

Jan. 8, 2016 (JP) ..... 2016-002919

(51) Int. Cl.
*B65D 77/20* (2006.01)
*B65D 5/24* (2006.01)
(Continued)

(52) U.S. Cl.
CPC ..... *B65D 77/2024* (2013.01); *B65D 5/24* (2013.01); *B65D 5/246* (2013.01); *B65D 5/30* (2013.01);
(Continued)

(58) Field of Classification Search
CPC ..... B65D 77/2024; B65D 5/24; B65D 5/246; B65D 85/78; B65D 77/20; B65D 5/64; B65D 5/30
See application file for complete search history.

(56) References Cited

U.S. PATENT DOCUMENTS 2,800,266 A * 7/1957 Kelly ..... B65D 5/12 229/125.26
3,159,303 A * 12/1964 Betner ..... B65D 17/401 220/270
(Continued)

FOREIGN PATENT DOCUMENTS

CN 102414089 A 4/2012
JP H04-050662 U 4/1992
(Continued)

OTHER PUBLICATIONS

Japan Patent Office, International Search Report issued in International Application No. PCT/JP2016/088882 (dated Feb. 28, 2017).
(Continued)

*Primary Examiner* — Kareen K Thomas
(74) *Attorney, Agent, or Firm* — Leydig, Voit & Mayer, Ltd.

(57) ABSTRACT

A lid 20 is a paper lid capable of adhering to a flange portion of a container body and includes: a tab 25; back half-cut lines 35*a*, 36*a* extending from the tab 25 outward and away from each other at an acute angle with respect to a paper grain direction K; back half-cut lines 37*a*, 38*a* extending from the outer ends of the back half-cut lines 35*a*, 36*a*, respectively, along the paper grain direction K; front half-cut lines 35*b*, 36*b* located on the outer side of the back half-cut lines 35*a*, 36*a* with a width W between the front and back half-cut lines and extending along the back half-cut lines 35*a*, 36*a* at an acute angle with respect to the paper grain direction K; and front half-cut lines 37*b*, 38*b* located on the
(Continued)

outer side of the back half-cut lines 37*a,* 38*a* with the width W between the front and back half-cut lines and extending along the back half-cut lines 37*a,* 38*a* and the paper grain direction K.

13 Claims, 10 Drawing Sheets

(51) Int. Cl.
*B65D 5/30* (2006.01)
*B65D 5/64* (2006.01)
*B65D 85/78* (2006.01)

(52) U.S. Cl.
CPC ..... *B65D 5/64* (2013.01); *B65D 77/20* (2013.01); *B65D 85/78* (2013.01)

(56) References Cited

U.S. PATENT DOCUMENTS 3,298,593 A * 1/1967 Stephenson ..... B65D 77/2008 206/45.3
3,580,478 A * 5/1971 Bemiss ..... B65D 5/64 229/123.2
4,113,103 A * 9/1978 Carlsson ..... B65D 5/703 229/125.04
4,308,985 A * 1/1982 Manizza ..... B65D 5/2047 206/497
4,351,473 A * 9/1982 Manizza ..... B65D 5/2047 229/123.2
4,531,668 A * 7/1985 Forbes, Jr. ..... B65D 77/206 229/123.2
5,002,223 A * 3/1991 Bolte ..... B65D 77/2044 220/276

FOREIGN PATENT DOCUMENTS

| | | | |
|---|---|---|---|
| JP | 2002-104486 | | 4/2002 |
| JP | 2002-347840 | | 12/2002 |
| JP | 2003-226351 | | 8/2003 |
| JP | 3924986 | B2 | 6/2007 |
| JP | 2009-057061 | | 3/2009 |
| JP | 5743618 | B2 | 7/2015 |
| JP | 2016-137921 | A | 8/2016 |
| TW | 201505920 | A | 2/2015 |
| TW | 201607856 | A | 3/2016 |

OTHER PUBLICATIONS

International Bureau of WIPO, International Preliminary Report on Patentability issued in International Application No. PCT/JP2016/088882 (dated Jul. 19, 2018).
Taiwan Intellectal Property Office, Office Action in Taiwanese Patent Application No. 106100437 (dated Feb. 27, 2020).

* cited by examiner (a)

(b)

PAPER LID AND STORAGE CONTAINER

CROSS-REFERENCE TO RELATED APPLICATIONS

This patent application is the U.S. National Stage of International Patent Application No. PCT/JP2016/088882, filed Dec. 27, 2016, which claims the benefit of Japanese Patent Application No. 2016-002919, filed Jan. 8, 2016, which are each incorporated by reference.

TECHNICAL FIELD

The present invention relates to a paper lid, and a storage container having the paper lid.

BACKGROUND ART

For example, as a container for storing ice cream, a storage container configured to seal the container by adhering a paper lid to a flange portion of a container body has been known (see, for example, Patent Literatures 1 and 2). From this storage container, the contents such as ice cream can be taken out by opening the center portion of the paper lid, which is not adhered to the flange portion. The paper lid described in Patent Literature 1 is provided with a tab for starting to open the storage container at a corner. The paper lid of the storage container is opened from the corner along the peripheral edge of the flange portion by separating the paper lid into the adhered portion and the center portion (lid portion) by delamination in the longitudinal direction and the lateral direction. Opening of the paper lid is realized by providing the lid with a back half-cut line formed by making half-cuts from the back side of the lid and a front half-cut line formed by making half-cuts from the front side of the lid to surround the back half-cut line, the back half-cut line and the front half-cut line being provided along the inner periphery of the flange portion, and by causing delamination of the paper substrate between these half-cut lines.

CITATION LIST

Patent Literature

Patent Literature 1: Japanese Patent No. 3924986
Patent Literature 2: Japanese Patent No. 5743618

SUMMARY OF INVENTION

Technical Problem

However, as illustrated in FIG. 10, in a conventional paper lid 100, the paper grain direction is not necessarily taken into consideration for a back half-cut line 101 and a front half-cut line 102. In other words, both the half-cut lines 101*a* and 102*a* extending in a direction along the paper grain direction (for example, the horizontal direction in FIG. 10) and both the half-cut lines 101*b* and 102*b* extending in a direction orthogonal to the paper grain direction (for example, the vertical direction in FIG. 10) were present. Therefore, when opening the lid 100 of the storage container, delamination is carried out relatively smoothly between the half-cut lines 101*a* and 102*a* along the paper grain direction, but, between the half-cut lines 101*b* and 102*b* in the direction orthogonal to the paper grain direction, delamination does not necessarily take place along the half-cut lines 101*b* and 102*b*. Consequently, paper residue or rupture in the middle of the half-cut lines occurs, and there is a possibility that the lid of the storage container is not reliably opened.

The present invention is intended to solve the above-described problems, and it is an object of the present invention to provide a paper lid capable of more reliably opening the paper lid adhered to a container body, and a storage container having the paper lid.

Solution to Problem

As one aspect, the present invention relates to a paper lid with a back surface capable of adhering to a flange portion of a container body capable of storing a predetermined content. The paper lid comprises: a tab provided on one end side of the paper lid in the paper grain direction; first back half-cut lines for opening that extend from the tab outward and away from each other at an acute angle with respect to the paper grain direction; second back half-cut lines for opening that extend from outer ends of the first back half-cut lines for opening, respectively, along the paper grain direction; first front half-cut lines for opening that are located on the outer side of the first back half-cut lines for opening, respectively, with a constant width between the first front and back half-cut lines and extend along the back half-cut lines for opening at an acute angle with respect to the paper grain direction; and second front half-cut lines for opening that are located on the outer side of the second back half-cut lines for opening, respectively, with a constant width between the second front and back half-cut lines and extend along the back half-cut lines for opening and the paper grain direction.

In this paper lid, none of the first and second front half-cut lines for opening and the first and second back half-cut lines for opening, which cause delamination after opening is started, is orthogonal to the paper grain direction. Further, the second front half-cut lines for opening and the second back half-cut lines for opening, which are far from the tab and less likely receiving the force evenly when causing delamination, are formed to extend along the paper grain direction. According to this paper lid, the paper lid adhered to the container body can be opened along the paper grain direction, or not along the direction orthogonal to the paper grain direction. Therefore, paper rupture and paper reside unlikely occur during opening, and it is possible to more reliably open the lid. Here, the expression "along the paper grain direction" also includes the meaning "substantially parallel to the paper grain direction" and includes a deviation of plus and minus 5 degrees with respect to the paper grain direction. The "front half-cut line" in the above-mentioned paper lid is a cut line formed by making a cut from the front surface of the paper lid without reaching the back surface, and the "back half-cut line" is a cut line formed by making a cut from the back surface of the paper lid without reaching the front surface.

In the paper lid, it is preferable that the width of the inner portion of the tab, which is adhered to the flange portion is narrower than the width of the outer portion of the tab. In this case, the area to be adhered to the flange portion can be reduced, and consequently initial opening can be easily and reliably performed.

In the paper lid, it is preferable that at least either the first front half-cut lines for opening or the first back half-cut lines for opening are inclined at an angle smaller than 80 degrees with respect to the paper grain direction. With such an inclination angle, it is possible to more reliably realize delamination at the initial stage.

The paper lid further comprises: cut lines provided on both sides of the tab and extending toward the center of the paper lid; opening-confirmation back half-cut lines extending from the center side ends of the cut lines, respectively, wherein the first back half-cut lines for opening preferably extend outward from the center side ends of the opening-confirmation back half-cut lines, respectively. In this case, it is possible to more smoothly separate the lid because of the cut lines. In the above case, the paper lid may further comprise spare cut lines extending along the paper grain direction on the outer side of the cut lines, respectively. By providing such spare cut lines, even if separation along the primary cut lines is not successful and deviates from the primary cut lines, the deviation is corrected by the spare cut lines and guided to the first front half-cut lines for opening. Thus, it is possible to more reliably carry out the initial opening.

In the paper lid, at least either the first front half-cut lines for opening or the first back half-cut lines for opening may have a corrugated form or a zipper form. In this case, when the lid is opened by opening the paper lid, the opened sides have a gently uneven form, and therefore it is possible to prevent the user's fingers from being injured.

The paper lid may further comprise either a third front half-cut line for opening or a third back half-cut line for opening, the third front half-cut line connecting the ends of the second front half-cut lines for opening to each other on the other end side in the paper grain direction and the third back half-cut line connecting the ends of the second back half-cut lines for opening on the other end side in the paper grain direction. By providing one of the third front half-cut line and back half-cut line for opening, the lid which has been separated except the portion on the other end side in the paper grain direction can be kept in an opened state about the other end side as the axis, and the lid can also be closed if necessary. In the case where both the third front half-cut line and back half-cut line for opening are provided, the portion on the other end side in the paper grain direction can also be separated by delamination, and thus it is possible to completely remove the separated lid. Note that the third front half-cut line and back half-cut line for opening may extend orthogonally to the paper grain direction, but these lines are the final part to be opened, and therefore even if paper residue or the like occurs, it is rarely a problem in actual use.

In the paper lid, it is preferable that the tab is located at substantially the center in the cross direction orthogonal to the paper grain direction. In this case, opening of the lid can proceed substantially evenly from the center to the left and right, and consequently the lid adhered to the container body can be opened reliably in a more balanced manner.

The present invention relates, as another aspect, to a storage container comprising any one of the above-described paper lids, and a container body having a flange portion to which the paper lid is adhered. According to this storage container, it is possible to exhibit any one of the above-mentioned effects.

In the above-described storage container, it is preferable that the flange portion of the container body has an adhesion area to be adhered to the tab of the paper lid, and the adhesion area has opening-assist half-cut lines extending along the cut lines located on both sides of the tab. By forming such opening-assist half-cut lines on the container body side, it is possible to easily cause delamination in the adhesion area in the flange portion of the container body, and the tab can be more reliably opened.

In the above storage container, the opening-assist half-cut lines may include first opening-assist half-cut lines that are substantially coincident with the cut lines, and second and third opening-assist half-cut lines extending parallel to the first opening-assist half-cut lines and located on the inner side and outer side of the first opening-assist half-cut lines. In this case, even if slight misalignment occurs during positioning when adhering the flange of the container body and the lid, it is possible to keep a high possibility that any one of the opening-assist half-cut lines coincides with the cut line of the lid, and even when a large number of storage containers are manufactured, it is possible to more reliably realize the opening function.

Advantageous Effects of Invention

According to the present invention, it is possible to provide a paper lid capable of more reliably opening the paper lid adhered to a container body, and a storage container having the paper lid.

DESCRIPTION OF EMBODIMENTS

The following will describe in detail a paper lid and a storage container having the paper lid according to the present invention with reference to the drawings. In the description, the same elements or elements having the same functions may be denoted by the same reference signs, and redundant description will be omitted.

First Embodiment

Figure 1:
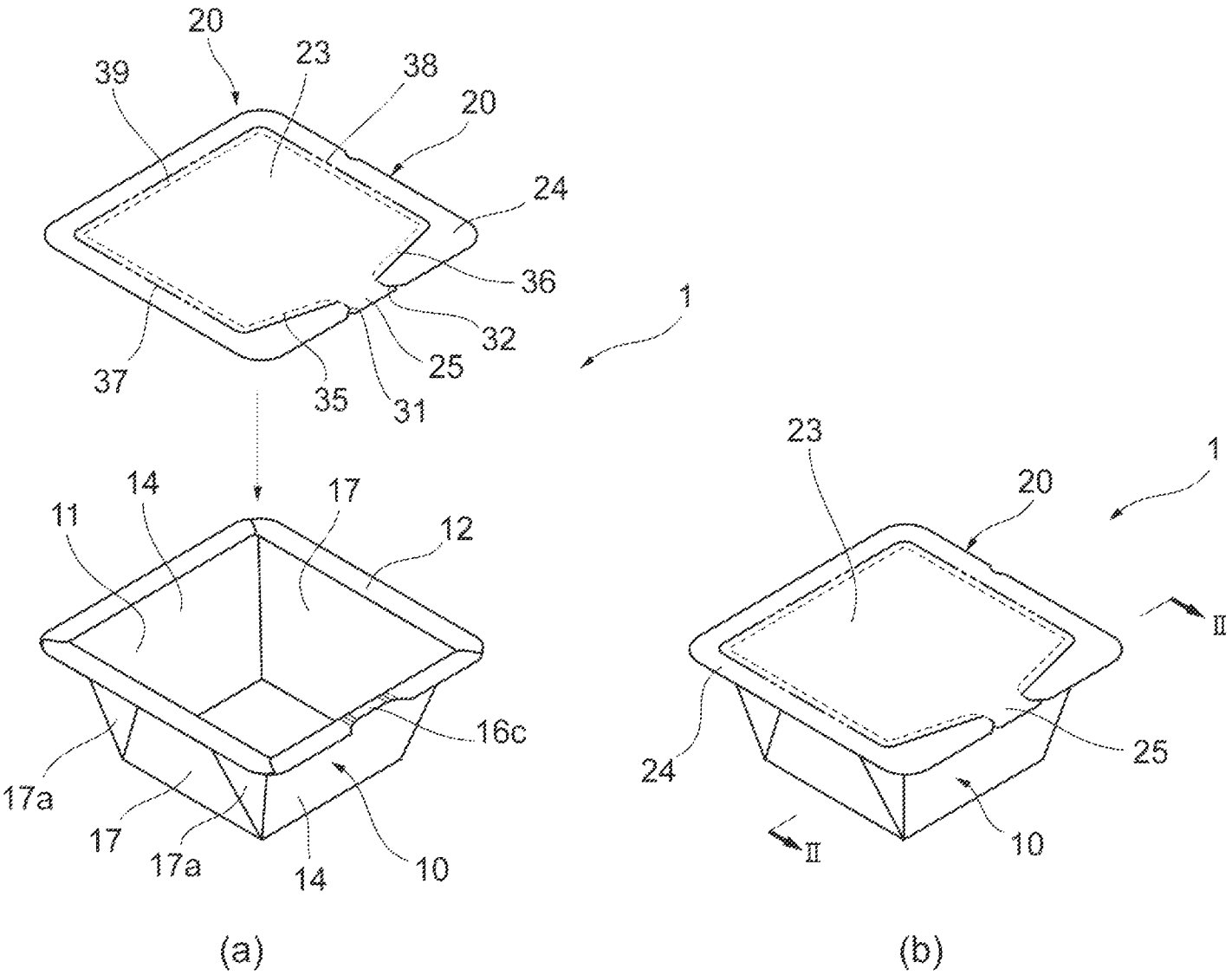
FIG. 1 is a perspective view of a storage container according to the first embodiment of the present invention, in which FIG. 1(*a*) is an exploded perspective view and FIG. 1(*b*) is a perspective view when the storage container is sealed by adhering a paper lid to a container body.
Figure 2:
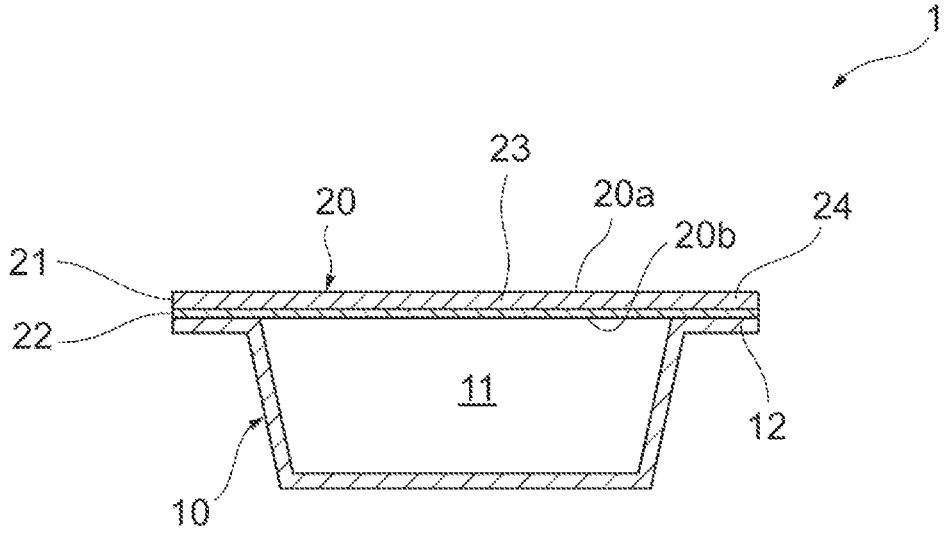
FIG. 2 is a cross-sectional view of the storage container taken along the II-II line illustrated in FIG. 1(*b*).

FIG. 1 is a perspective view showing a storage container according to the first embodiment of the present invention, in which FIG. 1(*a*) is an exploded perspective view and FIG. 1(*b*) is a perspective view when the storage container is sealed by adhering a paper lid to a container body. FIG. 2 is a cross-sectional view of the storage container taken along the II-II line illustrated in FIG. 1(*b*). As illustrated in FIG. 1 and FIG. 2, a storage container 1 comprises a container body 10 with a rectangular opening, and a lid 20 having a rectangular shape as a whole. The container body 10 is, for example, a paper or plastic container, and includes a storage portion 11 in the inner side thereof. For example, ice cream or the like is stored in the storage portion 11. The container body 10 further includes a flange portion 12 with a predetermined width on the upper peripheral edge of the storage portion 11. The opening of the container body 10 and the lid 20 are preferably rectangular in shape, but are not necessarily limited to the rectangular shape and may be, for example, circular in shape.

Figure 3:
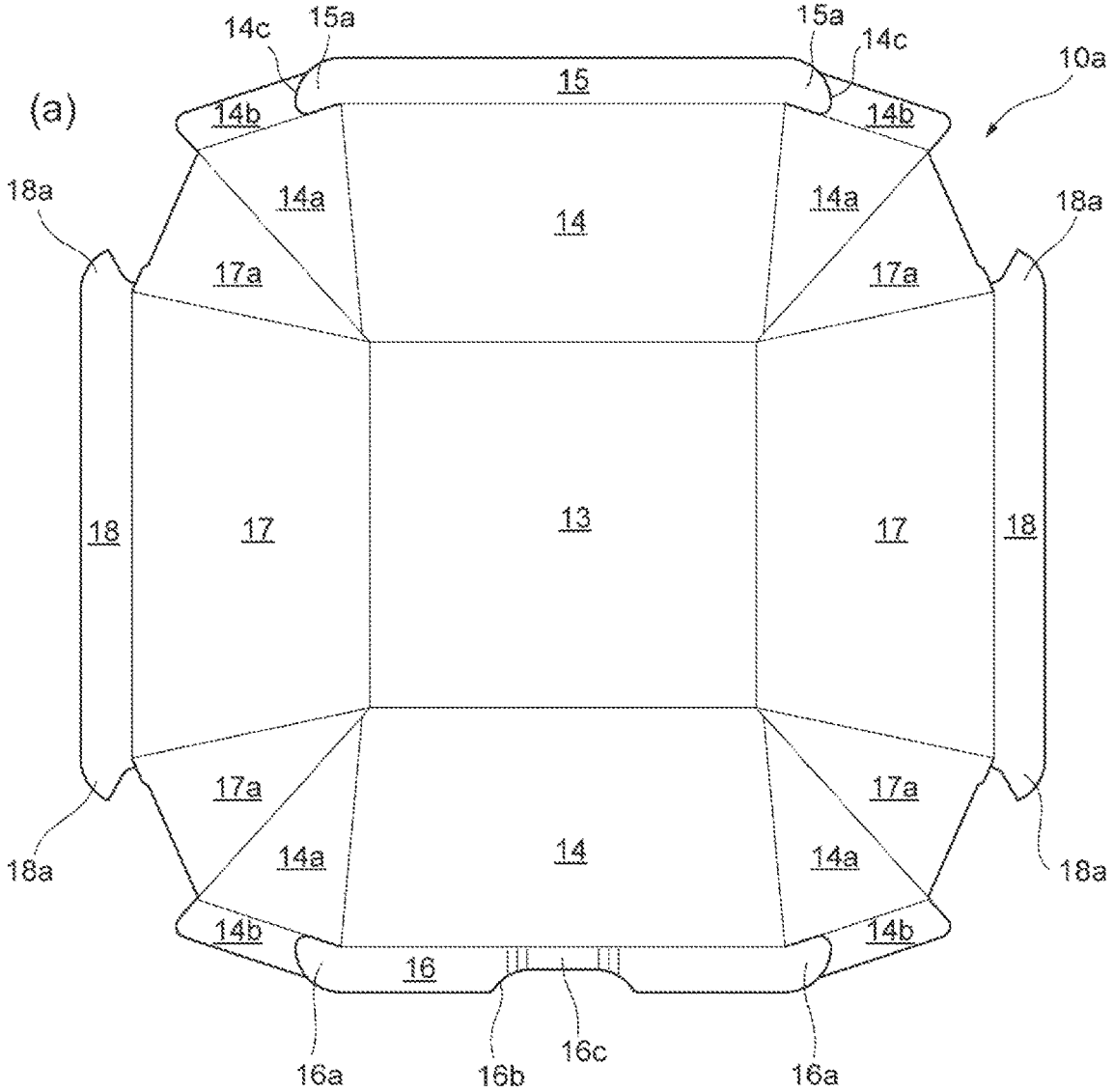
FIG. 3(*a*) is a plan view showing a blank of the container body of the storage container illustrated in FIG. 1, and FIG. 3(*b*) is a partially enlarged plan view thereof.
Figure 3:
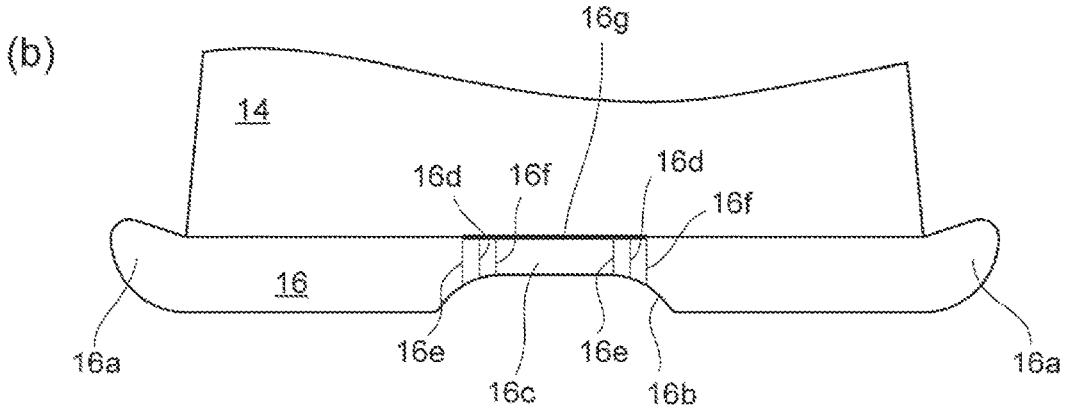

Such a container body 10 is a box-shaped container and is constructed, for example, from a blank 10*a* illustrated in FIG. 3(*a*). The blank 10*a* is composed of a square bottom plate 13, two side plates 14 connected to the sides of the bottom plate 13 located at the upper side and the lower side in FIG. 3(*a*) through mountain-fold lines, edge pieces 15, 16 connected to the outer side of the respective side plates 14 through valley-fold lines, two side plates 17 connected to the sides of the bottom plate 13 located on the left and right in FIG. 3(*a*) through mountain-fold lines, and edge pieces 18 connected to the outer side of the respective side plates 17 through valley-fold lines. Provided at the left and right ends of the edge pieces 15, 16 of the blank 10*a* are tongue pieces 15*a*, 16*a* extending in the lateral direction. Provided also at the upper and lower ends of the edge pieces 18 of the blank 10*a* are tongue pieces 18*a* extending in the vertical direction. As illustrated in FIG. 1(*a*), these edge pieces 15, 16, 18 constitute the above-mentioned flange portion 12 when the blank 10*a* is assembled into a box-shape (the container body 10).

Additionally, in the blank 10*a*, an inverted triangular joint plate 14*a* is connected to each of the left and right sides of the side plates 14 through a mountain-fold line, and a joint edge piece 14*b* is further connected to the outer side of the joint plate 14*a* through a valley-fold line. The joint edge piece 14*b* forms the same plane as the tongue piece 15*a* through a cut 14*c*. Moreover, in the blank 10*a*, inverted triangular joint plates 17*a* are connected through mountain-fold lines to the upper and lower sides of the side plate 17, respectively. These joint plates 14*a* and 17*a* form the same plane through valley-fold lines. The blank 10*a* is assembled into the box-shaped container body 10 illustrated in FIG. 1(*a*) by folding the blank 10*a* along the line between the joint plates 14*a*, 17*a* so that the joint plates 14*a*, 17*a* protrude outward and folding the edge pieces 15, 16, 18 downward to form the flange portion 12. The joint plates 14*a* and 17*a* folded outward are assembled into the box shape by adhering the outer surface of the joint plate 17*a* to the outer surface of the side plate 17. Such a basic structure of the container body 10 is a prior art and is disclosed, for example, in Japanese Unexamined Patent Publication No. 2012-188159.

In addition, as will be described in detail later, a notch 16*b* is formed on the middle outer side of the edge piece 16 (a part of the flange portion 12) of the blank 10*a* constituting the container body 10 according to the present embodiment as illustrated in FIG. 3(*b*). An area with a narrower width due to the notch 16*b* is an adhesion area 16*c* to be adhered to a tab 25 of the lid 20 (see FIG. 1(*a*)). In the adhesion area 16*c*, a pair of three left opening-assist half-cut lines 16*d* to 16*f* and three right opening-assist half-cut lines 16*d* to 16*f* are provided parallel to each other on the front side, in FIG. 3(*b*), of the blank 10*a* (the storage inner side of the container body 10). An opening-assist half-cut line 16*g* is formed to connect the ends of the opening-assist half-cut lines 16*d* to 16*f* on the side plate 14 side.

Returning to FIG. 2, the description will be continued. The lid 20 is a paper lid, and is composed of a paper substrate 21 and an adhesive layer 22 thinly layered on the back surface of the paper substrate 21 as illustrated in FIG. 2. A peripheral edge portion 24 of the lid 20 is adhered to the flange portion 12 of the container body 10 through the adhesive layer 22 to close the storage portion 11 with a lid portion 23. The adhesive layer 22 may be layered on the entire back surface of the paper substrate 21, or may be layered only on a part corresponding to the peripheral edge portion 24 to be adhered to the flange portion 12. For ease of description, as shown in FIG. 2 and other figures, the upper surface of the lid 20 is denoted as a front surface 20*a*, and a surface on the storage portion 11 side is denoted as a back surface 20*b* in the following description.

The paper substrate 21 mainly constituting the lid 20 is made of, for example, cardboard with a basis weight of 200 $g/m^2$ to 500 $g/m^2$. Since it is necessary to perform predetermined printing on the front surface 20*a* of the paper substrate 21, paper such as coated manila, coated cardboard or ivory with at least one side is white can be used. Further, since the back surface 20*b* of the lid 20 needs to be adhered to the flange portion 12 of the container body 10, it is possible to use a film with excellent sealing ability, such as, for example, a thin polyethylene film or polypropylene film with a thickness of 15 μm to 80 μm as the adhesive layer 22. For the storage container 1, the paper substrate 21 is laminated with such a film to produce the lid 20. Instead of the laminate, a polyethylene resin or the like (adhesive layer 22) may be extruded on the paper substrate 21 through an adhesive to produce the lid 20. If the contents are food, the film constituting the adhesive layer 22 may have hygiene, moisture resistant functions, etc.

As illustrated in FIG. 1, the lid 20 having the layer structure as described above can be divided into three parts in the planar direction. In other words, the lid 20 includes a lid portion 23 located at the center for closing the storage portion 11 of the container body 10, a peripheral edge portion 24 for adhesively fixing the lid 20 to the flange portion 12 of the container body 10, and a tab 25 serving as a piece for starting to open the lid portion 23. The tab 25 is located at substantially the center on one end in the planar direction of the lid 20. The lid portion 23 and the tab 25 are formed as one piece, and various cut lines 31, 32 and half-cut lines 35 to 39 are formed between the lid portion 23 and tab 25 and the peripheral edge portion 24 as to be described in detail later. In the storage container 1 with the lid 20 having such a configuration, the tab 25 is peeled from the flange portion 12 by gripping the tab 25 with a hand and pulling up the tab 25 from the lower right toward the upper left in FIG. 1, and thereafter the lid portion 23 and the tab 25 are separated from the peripheral edge portion 24 to open the lid portion 23.

Figure 4:
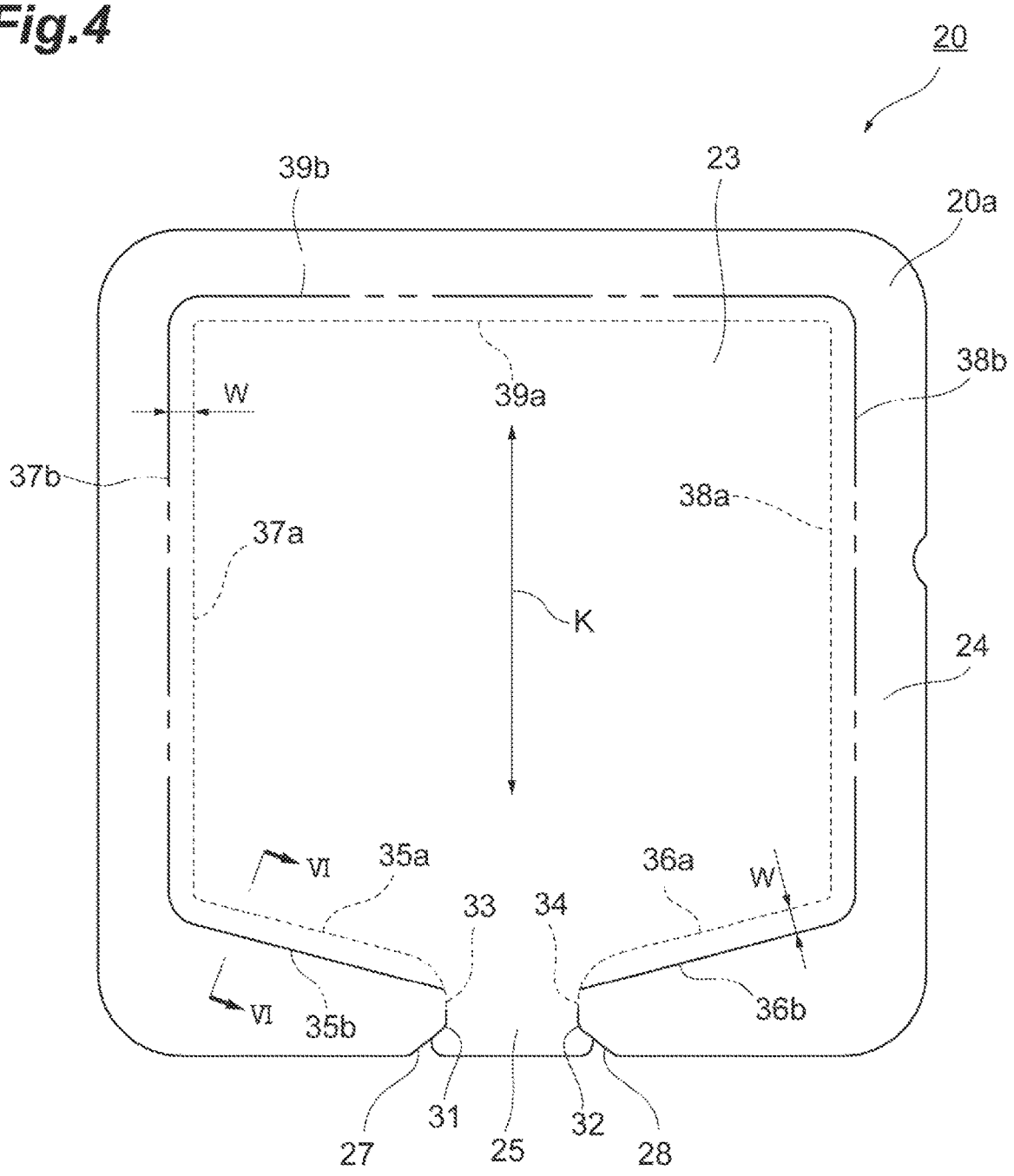
FIG. 4 is a plan view of the paper lid constituting the storage container illustrated in FIG. 1 when viewed from the front surface.
Figure 5:
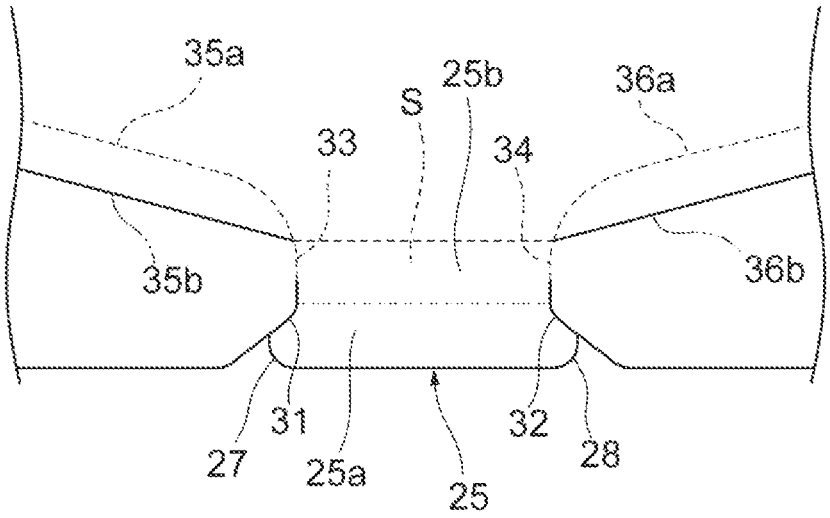
FIG. 5 is a partially enlarged plan view enlarging the periphery of the tab of the paper lid illustrated in FIG. 4.

Next, with reference to FIGS. 4 and 5, the configuration of the lid 20 will be described in more detail. FIG. 4 is a plan view of the paper lid constituting the storage container illustrated in FIG. 1 when viewed from the front surface 20*a*. FIG. 5 is a partially enlarged plan view enlarging the periphery of the tab of the paper lid illustrated in FIG. 4. In FIGS. 4 and 5, the dotted line indicates a back half-cut line formed on the back surface 20*b*, and the two-dot chain line indicates a front half-cut line formed on the front surface 20*a*. The back half-cut line is a cutting-assist line formed by making cuts from the back surface 20*b* of the lid 20 toward the front surface 20*a*, and does not penetrate to the front surface 20*a*. The front half-cut line is a cutting-assist line formed by making cuts from the front surface 20*a* of the lid 20 toward the back surface 20*b*, and does not penetrate to the back surface 20*b*.

As illustrated in FIG. 4, formed between the lid portion 23 and tab 25 and the peripheral edge portion 24 of the lid 20 are opening-starting cut lines 31 and 32, opening-confirmation back half-cut lines 33 and 34, first back half-cut lines 35*a* and 36*a* for opening, first front half-cut lines 35*b* and 36*b* for opening, second back half-cut lines 37*a* and 38*a* for opening, second front half-cut lines 37*b* and 38*b* for opening, a third back half-cut line 39*a* for opening, and a third front half-cut line 39*b* for opening in this order from one end in a paper grain direction K where the tab 25 is located. As illustrated in FIG. 5, the tab 25 to be an opened end of the lid 20 is composed of a wide portion 25*a* with a large width on the outer side and a narrow portion 25*b* with a width narrower than the wide portion 25*a* on the inner side. In the flange portion 12 (the edge piece 16) of the container body 10, the notch 16*b* is formed at a position corresponding to the wide portion 25*a* so that flange portion 12 and the wide portion 25*a* are not in contact with each other. On the other hand, in the narrow portion 25*b*, the flange portion 12 (the adhesion area 16*c* of the edge piece 16) is adhered to the narrow portion 25*b*. An area S illustrated in FIG. 5 is, for example, an area where the flange portion 12 (the adhesion area 16*c* of the edge piece 16) and the tab 25 (the narrow portion 25*b*) are adhered to each other. In addition, notches 27 and 28 are formed on the outer side of the tab 25 to facilitate opening, but it is not necessarily to form the notches 27 and 28.

As illustrated in FIGS. 4 and 5, the cut lines 31, 32 are provided on both sides of the tab 25 composed of the above-described wide portion 25*a* and narrow portion 25*b*, and a part of each line is an opening-starting cut line extending toward the center in the planar direction of the paper substrate 21 along the paper grain direction K. Here, the expression "along the paper grain direction K" includes meaning "substantially parallel to the paper grain direction K" and is not limited only to "perfectly parallel", and also includes a deviation of plus and minus 5 degrees with respect to the paper grain direction K. This also applies to the following cases. The cut lines 31 and 32 are cut lines penetrating from the front surface 20*a* to the back surface 20*b* of the lid 20. The opening-confirmation back half-cut lines 33 and 34, extending further toward the center (the other end in the paper grain direction K) are formed from the center-side ends of the cut lines 31 and 32, respectively. The back half-cut lines 33 and 34 extend toward the center in the planar direction of the lid 20 along the paper grain direction K and are connected to inner ends of the later-described first back half-cut lines 35*a* and 36*a* for opening, respectively. The back half-cut lines 33 and 34 are cutting-assist lines formed by making cuts from the back surface 20*b* of the lid 20 toward the front surface 20*a* and do not penetrate to the front surface 20*a*. When the lid 20 is opened to the vicinity of the back half-cut lines 33 and 34, the corresponding surface of the lid 20 is torn, leaving a trace of opening. It is thus possible to inform the user of whether or not illegal opening was attempted.

The first back half-cut lines 35*a* and 36*a* for opening are extended outward and away from each other from the center-side ends of the back half-cut lines 33 or 34 (that is, from the tab 25) and inclined at a predetermined angle (acute angle) with respect to the paper grain direction K of the lid 20. In short, the back half-cut lines 35*a* and 36*a* are formed so as not to be orthogonal to the paper grain direction K. The angle formed by each of the back half-cut lines 35*a*, 36*a* and the paper grain direction K is an acute angle and is, for example, within a range of 45 degrees to 85 degrees, and more preferably within a range of 60 degrees to 80 degrees. Similarly to the back half-cut lines 33 and 34, the back half-cut lines 35*a* and 36*a* are cutting-assist lines formed by making cuts from the back surface 20*b* of the lid 20 toward the front surface 20*a*, and do not penetrate to the front surface 20*a*. The later-described second and third back half-cut lines 37*a*, 38*a* and 39*a* for opening are also cutting-assist lines with similar structure. The outwardly extended end (the other end) of each of the back half-cut lines 35*a*, 36*a* is connected to one end of the later-described second back half-cut line 37*a* or 38*a* for opening.

The first front half-cut lines 35*b* and 36*b* for opening are lines that are located on the outer side of the first back half-cut lines 35*a* and 36*a* for opening, respectively, with a constant width W between the first front and back half-cut lines, and extend along the back half-cut lines 35*a* and 36*a* for opening, respectively. The width W is, for example, about 1 mm to 3 mm. The front half-cut lines 35*b* and 36*b* are substantially parallel to the back half-cut lines 35*a* and 36*a*, and the angle formed by each of the front half-cut lines 35*b*, 36*b* and the paper grain direction K is similarly an acute angle, for example, within a range of 45 degrees to 85 degrees, and more preferably within a range of 60 degrees to 80 degrees. The inner ends of the front half-cut lines 35*b* and 36*b* are connected to the back half-cut lines 33 and 34, respectively, and the other ends are connected to one end of each of the later-described second front half-cut line 37*b* or 38*b* for opening. The front half-cut lines 35*b* and 36*b* are cutting-assist lines formed by making cuts from the front surface 20*a* of the lid 20 toward the back surface 20*b*, and do not penetrate to the back surface 20*b*. The later-described second and third front half-cut lines 37*b*, 38*b* and 39*b* for opening are also cutting-assist lines with similar structure.

The second back half-cut lines 37*a* and 38*a* for opening are lines extending along the paper grain direction K from the outer ends of the first back half-cut lines 35*a* and 36*a* for opening, respectively. Each of the back half-cut lines 37*a* and 38*a* extends along the paper grain direction K and is connected at the end (the other end) to the left end or right end, in FIG. 4, of the later-described third back half-cut line 39*a* for opening.

The second front half-cut lines 37*b* and 38*b* for opening are lines that are located on the outer side of the second back half-cut lines 37*a* and 38*a* for opening, respectively, with a constant width W between the second front and back half-cut lines, and extend along the half-cut lines 37*a* and 38*a*, respectively. In short, the front half-cut lines 37*b* and 38*b* extend from the outer ends of the front half-cut lines 35*b* and 36*b*, respectively, along the paper grain direction K. The front half-cut lines 37*b* and 38*b* extend along the paper grain direction K and are connected at the end to the left end or the right end, in FIG. 4, of the later-described third front half-cut line 39*b* for opening.

The third back half-cut line 39*a* for opening is a line connecting the ends of the second back half-cut lines 37*a* and 38*a* for opening and extending along a direction orthogonal to the paper grain direction K. The third front half-cut line 39*b* is a line which is located on the outer side of the back half-cut line 39*a* with a constant width W between the third front and back half-cut lines, and extends along the back half-cut line 39*a*. In short, the front half-cut line 39*b* extends along a direction orthogonal to the paper grain direction K from the end of each of the front half-cut lines 37*b* and 38*b*.

Figure 6:
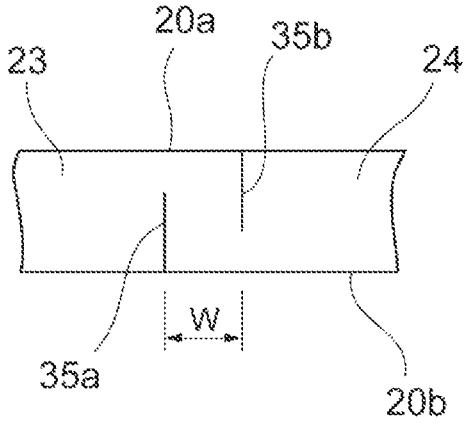
FIG. 6 is a partial cross-sectional view of the lid taken along the VI-VI line illustrated in FIG. 4, and is a view for explaining delamination.
Figure 6:
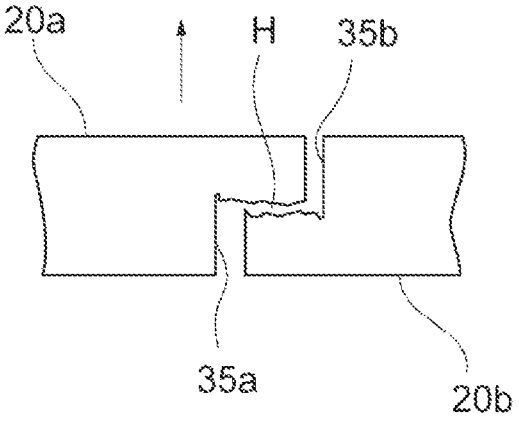

Here, with reference to FIGS. 4 to 6, the following will describe a flow of opening the storage container 1 covered with the lid 20 adhered to the flange portion 12 of the container body 10. In the storage container 1 according to the present embodiment, the storage container 1 and the lid 20 are adhered together so that the cut lines 31 and 32 formed on the side faces of the tab 25 substantially coincide with the opening-assist half-cut lines 16*d* (see FIG. 3) formed on the edge piece 16 of the container body 10, thereby assisting opening of the tab 25. Further, as described above, the opening-assist half-cut lines 16*e* and 16*f* extending in parallel with the opening-assist half-cut line 16*d* are provided on the inner side or outer side of each of the opening-assist half-cut lines 16*d* extending along the cut lines 31 and 32 so that even when the lid 20 and the container body 10 are misaligned slightly during adhesion, opening is similarly assisted by any one of the opening-assist half-cut lines 16*e* and 16*f*. The edge piece 16 of the container body 10 is further provided with the opening-assist half-cut line 16*g* so that delamination of the paper with the assistance of the opening-assist half-cut lines 16*d* to 16*f* does not extend to the inner side of the container body 10.

First, when opening the storage container 1, the user grips one end of the tab 25. When the gripped tab 25 is pulled up in the drawing, the peripheral edge portion 24 of the lid 20 and the tab 25 are separated from each other along the cut lines 31, 32 and the opening-assist half-cut lines 16*d*. Thereafter, when the tab 25 is further pulled up, cutting of the paper substrate 21 including the front surface 20*a* further proceeds along the back half-cut lines 33 and 34. At this time, delamination occurs between the back surface 20*b* of the paper substrate 21 adhered to the flange portion 12 and the front surface 20*a*.

Subsequently, when the tab 25 is kept pulled, first, cutting along the back half-cut lines 33 and 34 leads to cutting along the first front half-cut lines 35*b* and 36*b* for opening, and then when the tab 25 is further pulled, the cutting leads to cutting along the first back half-cut lines 35*a* and 36*a* for opening. Here, cutting by delamination between the front half-cut line 35*b* and the back half-cut line 35*a* will be described with reference to FIG. 6. As illustrated in FIG. 6(*a*), the half-cut line 35*b* formed from the front surface 20*a* and the half-cut line 35*a* formed from the back surface 20*b* are apart from each other with a constant width W between the half-cut lines 35*a* and 35*b* in the planar direction. When the opening force is applied to the lid 20 having such a configuration, as illustrated in FIG. 6(*b*), if the force directed upward is applied to the lid portion 23, the delamination strength is considerably weaker than the rupture strength in the upward direction of the paper, and consequently no linear rupture occurs and the upward force is diffused in oblique and lateral directions and causes delamination. Then, delamination H of the paper substrate 21 occurs between the vicinity of the end of the half-cut line 35*a* and the vicinity of the end of the half-cut line 35*b*, and the peripheral edge portion 24 and the lid portion 23 are separated from each other. Similar delamination occurs between the half-cut lines 36*a* and 36*b*, between the later-described half-cut lines 37*a* and 37*b*, between 38*a* and 38*b* and between 39*a* and 39*b*, and the peripheral edge portion 24 and the lid portion 23 are separated from each other.

Subsequently, when the cutting along the front and back half-cut lines 35*a*, 35*b*, 36*a*, 36*b* progresses, cutting by delamination along the second front and back half-cut lines 37*a*, 37*b*, 38*a*, 38*b* proceeds. By the cutting so far, it is possible to open the lid portion 23 about the front and back half-cut lines 39*a*, 39*b* as the axis located on the other end side in the paper grain direction K. When the tab 25 is further pulled, the cutting by delamination along the third front and back half-cut lines 39*a* and 39*b* proceeds, and the lid portion 23 is completely separated from the peripheral edge portion 24.

Thus, in the lid 20 according to the present embodiment, none of the first and second front half-cut lines 35*b* to 38*b* for opening and the first and second back half-cut lines 35*a* to 38*a* for opening is orthogonal to the paper grain direction K. In addition, the second front half-cut lines 37*b*, 38*b* for opening and the second back half-cut lines 37*a*, 38*a* for opening, which are far from the tab 25 and the force is less likely transmitted equally thereto when causing delamination, are formed to extend along the paper grain direction K. Therefore, according to the lid 20, it is possible to open the lid 20 adhered to the container body 10 along the paper grain direction K, or not along the direction orthogonal to the paper grain direction K. Therefore, paper rupture or paper reside will less likely occur during opening, and it is possible to more reliably open the lid 20.

Further, in the lid 20 according to the present embodiment, the first front half-cut lines 35*b*, 36*b* for opening and the first back half-cut lines 35*a*, 36*a* for opening are inclined with respect to the paper grain direction K at an angle smaller than 80 degrees. With such an inclination angle, delamination at the initial stage can be more certainly realized.

The lid 20 according to the present embodiment further includes the third front half-cut line 39*b* for opening and the third back half-cut line 39*a* for opening. By providing the third front and back half-cut lines 39*b* and 39*a*, the lid portion 23 which is separated except the other end side in the paper grain direction K can be kept in an opened state about the other end side as the axis, and the lid portion 23 can also be closed if necessary. Further, since the portion on the other end side in the paper grain direction K can also be separated by delamination, it is possible to completely remove the separated lid portion 23. Although the front and back half-cut lines 39*b* and 39*a* may extend orthogonally to the paper grain direction K, these lines are the final part to be opened, and therefore even if the paper residues, it is rarely a problem in actual use.

In the lid 20 according to the present embodiment, the tab 25 is formed at substantially the center in the cross direction orthogonal to the paper grain direction K. Therefore, opening of the lid 20 can be advanced substantially evenly to the left and right from the center, and the opening of the lid 20 adhered to the container body 10 can be carried out in a more balanced and reliable manner.

Second Embodiment

Figure 7:
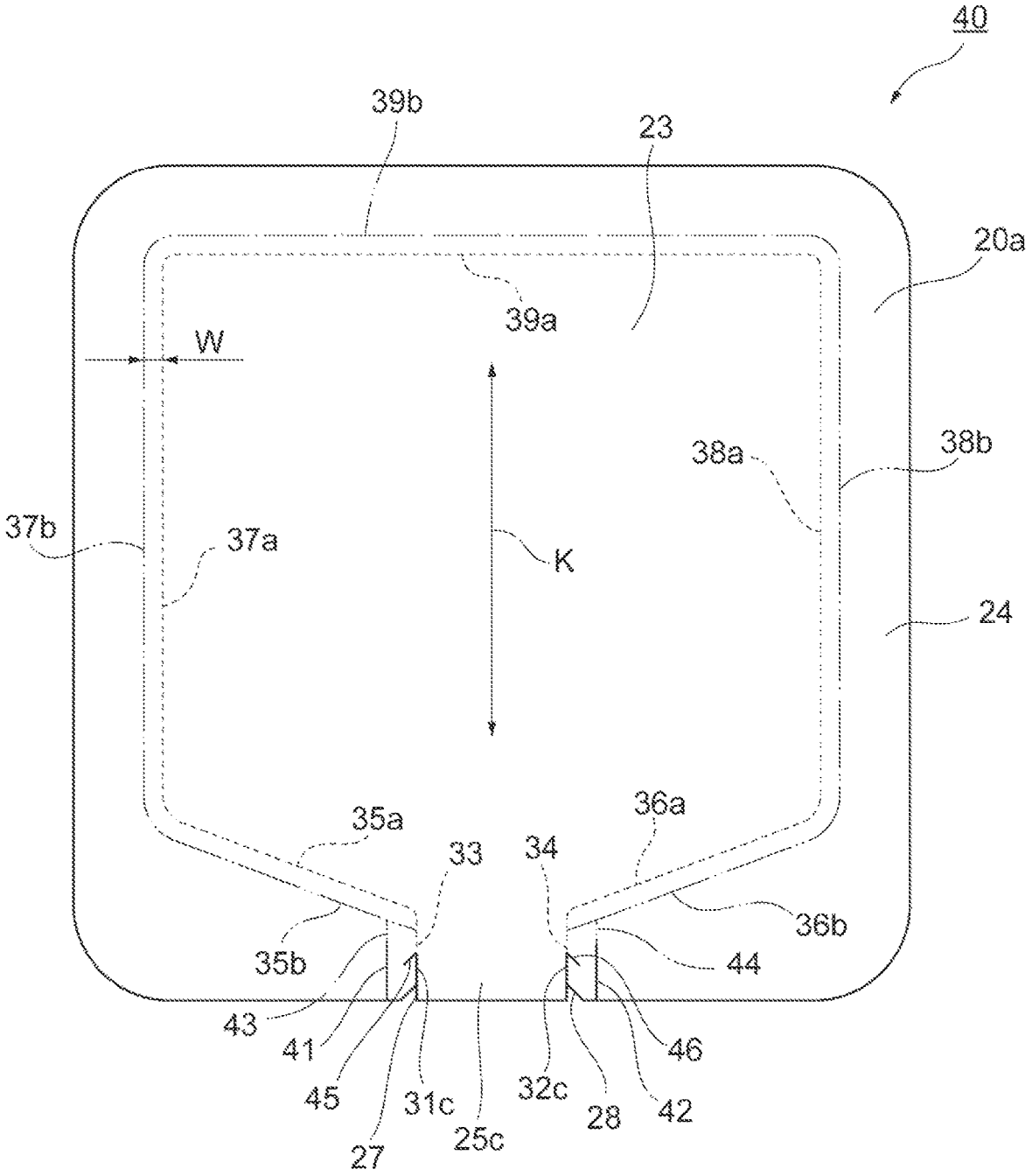
FIG. 7 is a plan view of a paper lid according to the second embodiment when viewed from the front surface.

Next, the second embodiment of the present invention will be described with reference to FIG. 7. FIG. 7 is a plan view when a paper lid according to the second embodiment is viewed from the front surface. A lid 40 according to the second embodiment differs from the lid 20 according to the first embodiment in the shape of the tab and also in that spare cut lines are provided. Since other structures of the lid 40 and the container body to which the lid 40 is adhered are the same as those in the first embodiment, description thereof will be omitted.

First, unlike the tab 25 of the first embodiment, a tab 25*c* of the lid 40 has a uniform width. Therefore, the cut lines 31*c* and 32*c* are also linear and are entirely along the paper grain direction K.

Further, formed on the outer side of the opening-starting cut lines 31*c* and 32*c* of the lid 40 are opening-starting spare cut lines 41, 42, opening-starting spare back half-cut lines 43, 44, and opening-starting spare cut lines 45 and 46. The front half-cut lines 35*b* and 36*b* are connected to the opening-starting spare cut lines 41 and 42 through the back half-cut lines 43 and 44, respectively, in the vicinity of their one ends on the tab 25*c* side.

The opening-starting spare cut lines 41 and 42 are cut lines formed substantially parallel on the outer side of the opening-starting cut lines 31*c* and 32*c* and function as auxiliary cut lines if separation along the cut lines 31*c* and 32*c* is unsuccessful. By providing the spare cut lines 41 and 42, even if separation along the primary cut lines 31*c* and 32*c* fails and is deviated from the cut lines 31*c* and 32*c*, a correction is made by the spare cut lines 41 and 42, and it is possible to guide the separation to the first front half-cut lines 35*b* and 36*b* for opening through the back half-cut lines 43 and 44.

Like the spare cut lines 41 and 42, the opening-starting spare cut lines 45 and 46 serve as auxiliary cut lines if separation along the cut lines 31*c* and 32*c* is not successful. By providing the spare cut lines 45 and 46, even if misalignment occurs between the cut lines 31*c*, 32*c* and the back half-cut lines 33, 34 due to errors in manufacturing, cutting is performed from the extension lines of the spare cut lines 45, 46 and back half-cut lines 33, 34 when opening the lid 40, and thus opening is reliably carried out.

As described above, the lid 40 according to the present embodiment further includes the spare cut lines 41 and 42 extending on the outer side of the cut lines 31*c* and 32*c*. Therefore, according to the lid 40, in addition to obtaining the same operational effects as those of the first embodiment, since the spare cut lines 41 and 42 are provided, even if separation along the primary cut lines 31*c* and 32*c* is unsuccessful and deviated from the primary cut lines 31*c* and 32*c*, the separation can be corrected by the spare cut lines 41 and 42 and can be guided to the first front half-cut lines 35*b* and 36*b* for opening, and consequently initial opening can be more reliably carried out.

Third Embodiment

Figure 8:
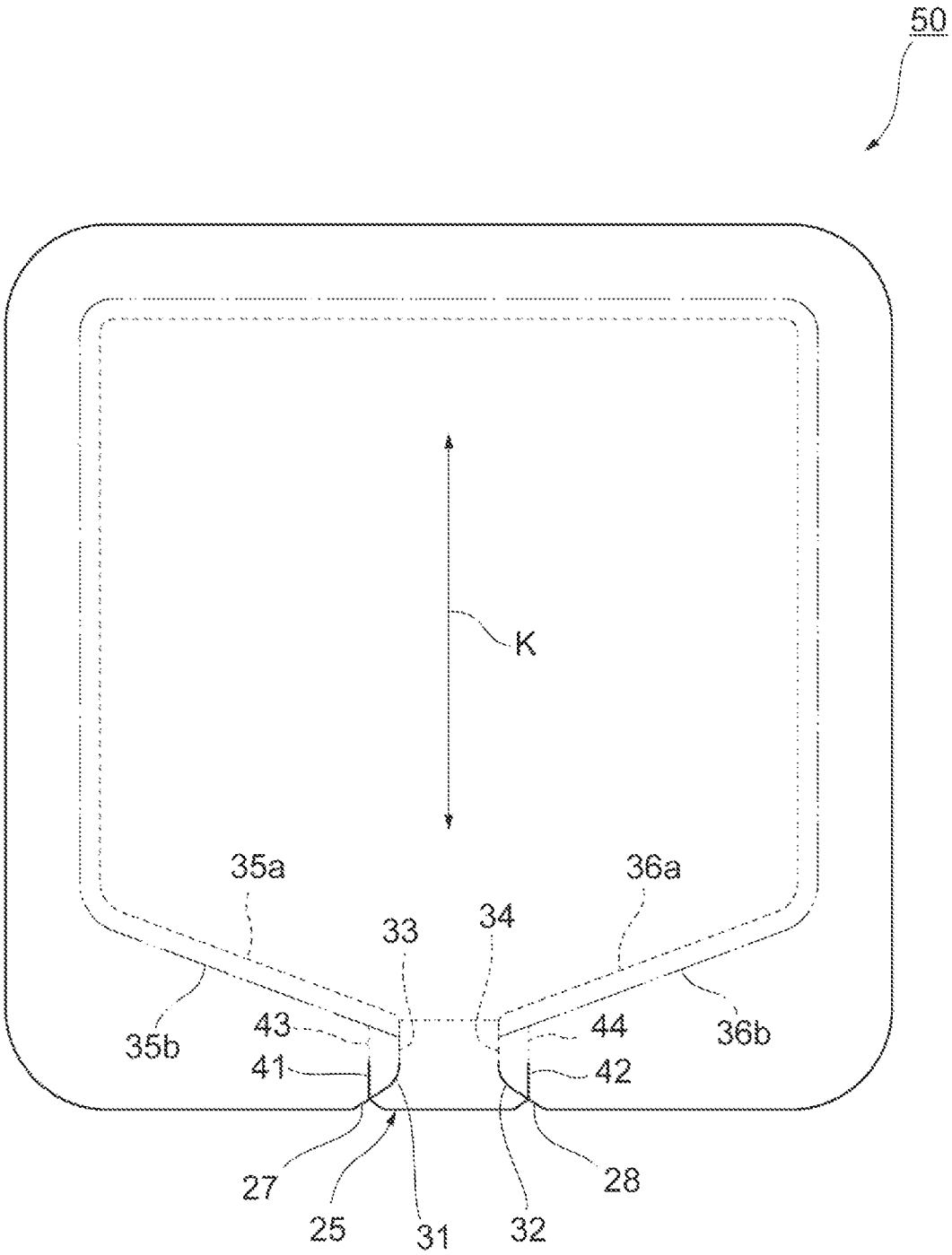
FIG. 8 is a plan view of a paper lid according to the third embodiment when viewed from the front surface.

Next, the third embodiment of the present invention will be described with reference to FIG. 8. FIG. 8 is a plan view when a paper lid according to the third embodiment is viewed from the front surface. A lid 50 according to the third embodiment is similar to the lid 20 according to the first embodiment in the shape of the tab, but differs in that spare cut lines are provided as in the second embodiment. Since the other structures of the lid 50 and the container body to which the lid 50 is adhered are the same as those of the first embodiment, description thereof will be omitted.

As illustrated in FIG. 8, formed on both sides of the tab 25 of the lid 50 are the spare cut lines 41 and 42, and back half-cut lines 43 and 44 extending from the spare cut lines 41 and 42. Therefore, according to the lid 50, in addition to obtaining the same operational effect as in the first embodiment, since the spare cut lines 41 and 42 are provided, even if separation along the primary cut lines 31 and 32 is unsuccessful and deviated from the primary cut lines 31 and 32, the separation can be corrected by the spare cut lines 41, 42 and can be guided to the first front half-cut lines 35*b* and 36*b* for opening, and consequently initial opening can be more reliably carried out.

The paper lid and the storage container having the lid according to the present embodiment have been described above, but the paper lid and the storage container having the paper lid according to the present invention are not limited to the above-described embodiments, and various modifications can be applied. For example, in the above-described embodiments, the first back half-cut lines 35*a*, 36*a* for opening and the first front half-cut lines 35*b*, 36*b* for opening are linear. However, these half-cut lines are not limited to linear lines, and at least either of these lines may have a corrugated form, a zipper form, or the like. By making the separation surfaces in such a form, when the lid is opened by opening the paper lid, the opened sides have a gently uneven form, thereby effectively preventing the user's fingers from being injured.

EXAMPLES

The following will describe the present invention in detail by way of examples, but the present invention is not limited to these examples.

Example 1

First, as Example 1, paper (coated cardboard) with a basis weight of 310 g/m$^2$ was prepared. After printing on the coated side, a polyethylene resin was extruded to a thickness of 45 μm to produce a material. The shape illustrated in FIG. 7 (FIG. 9(*a*)) was punched out of the prepared material to produce a lid, and a container body corresponding to the lid was heat sealed to produce samples No. 1 to No. 3 of the storage container (N=3 for each sample). In each of samples No. 1 to No. 3, the width P [mm] of the tab and the inclination angle Q [°] of the first half-cut line with respect to the paper grain direction K were set as shown in Table 1. Then, for the storage container of each sample, a test of opening the lid was carried out, and the following four evaluation items were measured and a comprehensive judgment was made. The values of the four evaluation items shown in Table 1 are average values in each sample.

[Ease of Gripping]

The ease of gripping the tab was evaluated on a scale of "1" to "5". For this evaluation item, "1" indicates that the tab cannot be gripped or it is difficult to exert the opening force, and as the number increases to "5", there is no problem at all in exerting the force to the tab.

[Initial Opening]

Whether opening was performed between the layers without lifting up the flange at the beginning of opening the lid was evaluated on a scale of "1" to "5". For this evaluation item, "1" indicates that the flange is lifted up and opening from the tray layer is not performed, and as the number increases to "5", the flange is not lifted up at all and opening from the tray layer is cleanly performed.

[Separation]

Whether or not the lid and the storage container were separated from each other at the flange edge portion was evaluated on a scale of "1" to "5". For this evaluation item, "1" indicates that the storage container and the lid are not separated from each other (the lid is torn or separated into two layers), and as the number increases to "5", there is no problem when separating the storage container and the lid from each other and the lid can be opened by a sequence of flows from the initial opening, that is, without requiring extra force.

[Following Half-Cuts]

Whether or not the lid was opened along the half-cut forms without deviation was evaluated on a scale of "1" to "5". For this evaluation item, "1" indicates that the lid is opened with deviation from the half-cut forms, and as the number increases to "5", the lid can be opened along the half-cut forms without deviation and also be opened by a sequence of flows from separation, that is, without requiring extra force, at the time of opening the lid.

Note that the comprehensive judgment was made by assigning weights, ease of gripping:initial opening:separation:following half-cuts=1:1:4:2.

TABLE 1

| No. | WIDTH P [mm] | ANGLE Q [°] | EASE OF GRIPPING | INITIAL OPENING | SEPERATION | FOLLOWING HALF-CUTS | COMPREHENSIVE JUDGEMENT |
|---|---|---|---|---|---|---|---|
| 1 | 8 | 76.5 | 1 | 2.5 | 3.5 | 3 | 2.94 |
| 2 | 10 | 69 | 1 | 3 | 3 | 4 | 3.00 |
| 3 | 8 | 69 | 1 | 2 | 3 | 3.5 | 2.75 |

Figure 9:
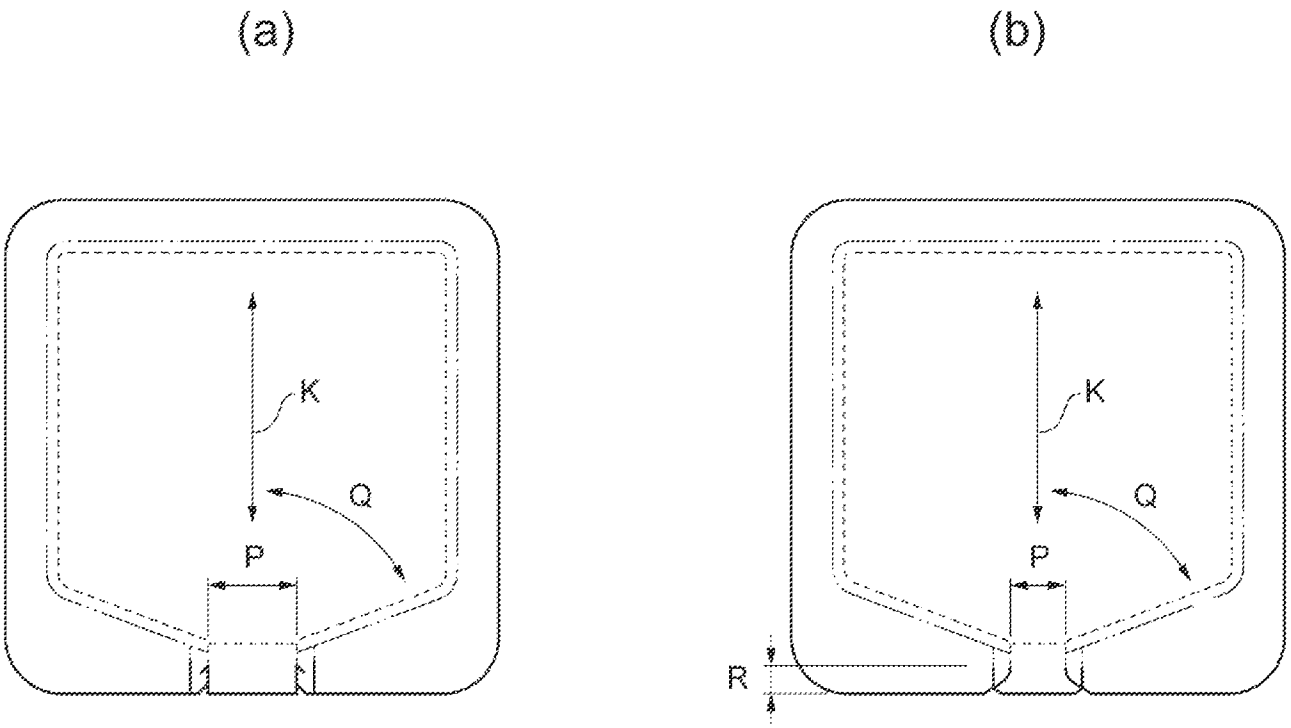
FIG. 9 is a reference diagram showing dimensions of an example of the paper lid.

As shown in Table 1, according to the lid body of the embodiment illustrated in FIG. 9(*a*), the lid was more reliably opened along the half-cut lines although there was some problem in the ease of gripping or slightly stronger force was required at the initial opening.

Example 2

Next, as Example 2, similarly to Example 1, paper (coated cardboard) with a basis weight of 310 g/m$^2$ was prepared, and after printing on the coated side, a polyethylene resin was extruded to a thickness of 45 μm to produce a material. The shape illustrated in FIG. 8 (FIG. 9(*b*)) was punched out of the material to produce a lid, and a container body corresponding to the lid was heat sealed to produce samples No. 1 to No. 6 of the storage container (N=6 for each sample). In each of samples No. 1 to No. 6, the width P [mm] of the tab, the inclination angle Q [°] of the first half-cut line with respect to the paper grain direction K, and the length R [mm] of the wide portion of the tab were set as shown in Table 2. Then, for the storage container of each of these samples, a test of opening the lid was carried out, and four evaluation items were measured and a comprehensive judgment was made in the same manner as in Example 1. Similarly to Table 1, the values of the four evaluation items shown in Table 2 are average values for each sample.

TABLE 2

| No. | WIDTH P [mm] | ANGLE Q [°] | LENGTH R [mm] | EASE OF GRIPPING | INITIAL OPENING | SEPERATION | FOLLOWING HALF-CUTS | COMPREHENSIVE JUDGEMENT |
|---|---|---|---|---|---|---|---|---|
| 1 | 10 | 84 | 4.5 | 5 | 5 | 5 | 2.5 | 4.38 |
| 2 | 10 | 76.5 | 4 | 5 | 3.5 | 5 | 5 | 4.81 |
| 3 | 10 | 69 | 3.5 | 4.5 | 3.5 | 5 | 3 | 4.25 |
| 4 | 12 | 76.5 | 3.5 | 4.5 | 4.5 | 3.5 | 5 | 4.13 |
| 5 | 12 | 69 | 4.5 | 4.5 | 5 | 5 | 5 | 4.94 |
| 6 | 14 | 84 | 3.5 | 4.5 | 5 | 3 | 3 | 3.44 |

As shown in Table 2, according to the lid body of the embodiment illustrated in FIG. 9(*b*), the evaluation of ease of gripping was greatly improved compared to Example 1, and the evaluation items: initial opening, separation and following half-cut were also improved compared to Example 1. Consequently, it was confirmed that it is possible to more reliably open the lid.

Comparative Example

As a comparative example, similarly to Examples 1 and 2, paper (coated cardboard) with a basis weight of 310 g/m$^2$ was prepared, and after printing on the coated side, a polyethylene resin was extruded to a thickness of 45 μm to produce a material. The shape illustrated in FIG. 10 was punched out of the material to produce a lid, and a container body corresponding to the lid was heat sealed to produce samples (N=6) of the storage container. Four evaluation items were measured and a comprehensive judgment was made in the same manner as in Example 1 and Example 2. Similarly to Tables 1 and 2, the values of the four evaluation items shown in Table 3 are average values for the samples (N=6) of the comparative example.

TABLE 3

| No. | WIDTH P [mm] | ANGLE Q [°] | LENGTH R [mm] | EASE OF GRIPPING | INITIAL OPENING | SEPERATION | FOLLOWING HALF-CUTS | COMPREHENSIVE JUDGEMENT |
|---|---|---|---|---|---|---|---|---|
| 1 | 12 | 45 | — | 5 | 4 | 2 | 2 | 2.625 |

Figure 10:
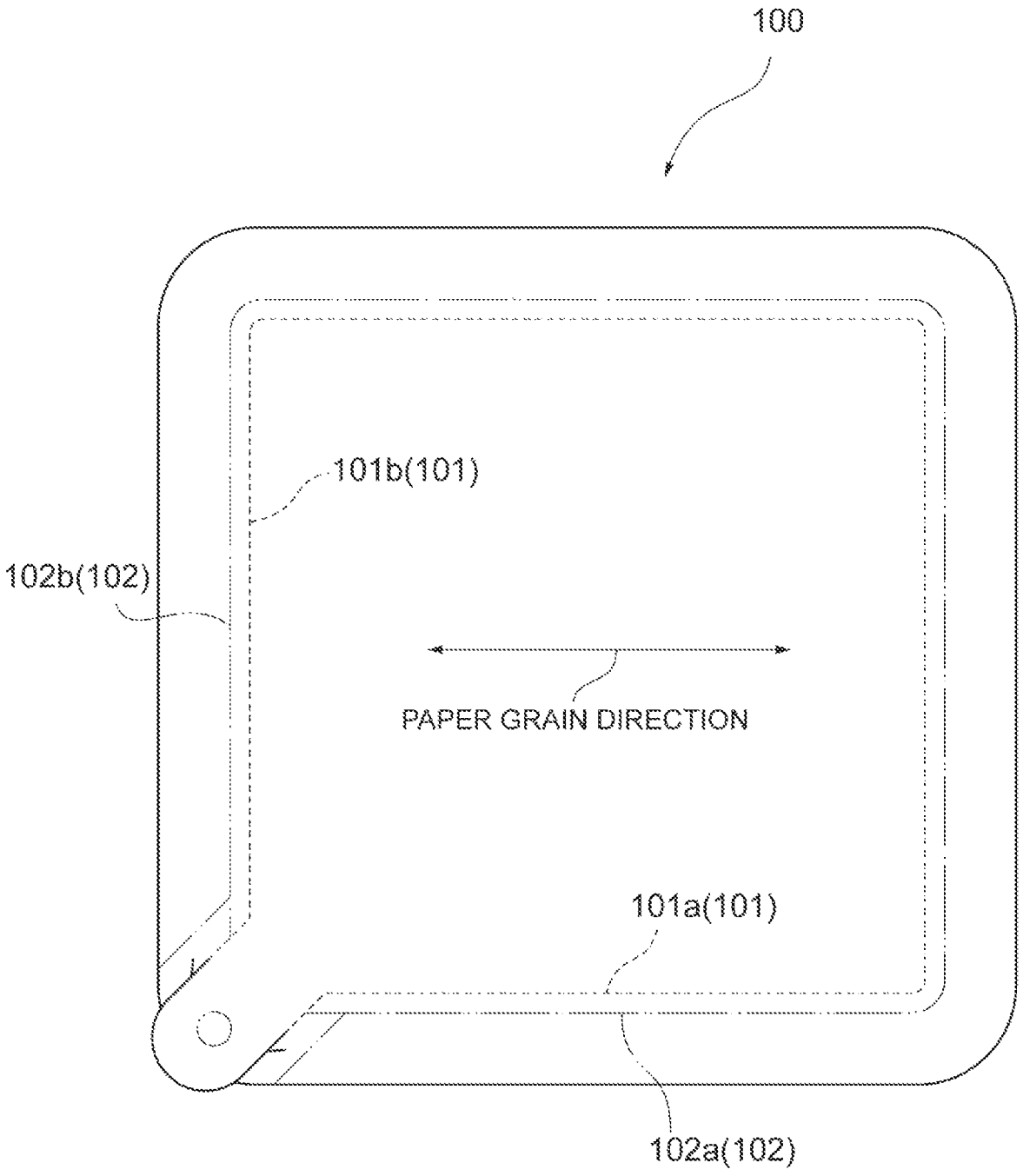
FIG. 10 is a plan view of a conventional paper lid when viewed from the front surface.

As shown in Table 3, although the form illustrated in FIG. 10 (prior art) showed excellent results for the ease of gripping and initial opening, there was difficulty in separating the storage container and the lid from each other, and even when the storage container and the lid were separated from each other, following half-cut was not satisfactory, and thus the results were poorer compared to Examples 1 and 2.

INDUSTRIAL APPLICABILITY

The present invention is applicable to a lid of a storage container for storing a predetermined content (for example, ice cream) and to a storage container having the lid.

REFERENCE SIGNS LIST

1: storage container, 10: container body, 12: flange portion, 16: edge piece, 16*c*: adhesion area, 16*d* to 16*f*: opening-assist half-cut lines, 20, 40, 50: lids, 25, 25*c*: tabs, 25*a*: wide portion, 25*b*: narrow portion, 31, 32, 31*c*, 32*c*: cut lines, 33, 34, 35*a* to 39*a*: back half-cut lines, 35*b* to 39*b*: front half-cut lines, 41, 42: spare cut lines, K: paper grain direction, and W: width.

The invention claimed is:

1. A paper lid:

the paper lid having a back surface capable of being adhered to a flange portion of a container body capable of storing a predetermined content, the paper lid comprising:

a paper having a grain direction;

a first tearable side and a second tearable side, wherein the first and second tearable sides run parallel to the grain direction; and a fixed side and a tabbed side, the tabbed side having a tab formed on an edge of the tabbed side, and wherein the fixed and tabbed sides run across the grain direction;

wherein, after adhering the paper lid to the flange portion, the tab is configured such that when it is pulled away from the flange portion of the container body, the pulling, allows the tearable sides to tear in a direction along the grain direction and the tabbed side to tear in a direction across the grain direction;

said tab having an inner portion and an outer portion;

wherein the inner portion of the tab is adhered to the flange portion and the inner portion of the tab has a width narrower than a width of the outer portion of the tab, and wherein the outer portion of the tab is an outer edge of the tab;

first back half-cut lines for opening that extend from the tab outward and away from each other at an acute angle with respect to the paper grain direction;

second back half-cut lines for opening that extend from outer ends of the first back half-cut lines for opening, respectively, along the paper grain direction;

first front half-cut lines for opening that are located on an outer side of the first hack half-cut lines for opening, respectively, with a constant width between the first front and back half-cut lines and extend along the back half-cut lines for opening, respectively, at an acute angle with respect to the paper grain direction; and second front half-cut lines for opening that are located on an outer side of the second back half-cut lines for opening, respectively, with a constant width between the second front and back half-cut lines and extend along the back half-cut lines for opening and the paper grain direction.

2. The paper lid according to claim 1, wherein at least either the first front half-cut lines for opening or the first back half-cut lines for opening are inclined at an angle smaller than 80 degrees with respect to the paper grain direction.

3. The paper lid according to claim 1, further comprising:

cut lines provided on both sides of the tab and extending toward a center of the paper lid; and opening-confirmation back half-cut lines extending further from center-side ends of the cut lines, respectively, wherein the first hack half-cut lines for opening extend outward from center-side ends of the opening-confirmation back half-cut lines, respectively.

4. The paper lid according to claim 3, further comprising: spare cut lines extending along the paper grain direction on outer sides of the cut lines, respectively.

5. The paper lid according to claim 1, wherein at least either the first front half-cut lines for opening or the first hack half-cut lines for opening have a corrugated form or a zipper form.

6. The paper lid according to claim 1, further comprising: at least either a third front half-cut line for opening or a third back half-cut line for opening, the third front half-cut line connecting ends of the second front half-cut lines for opening together on another end side in the paper grain direction, the third back half-cut line connecting ends of the second hack half-cut lines for opening together on the other end side in the paper grain direction.

7. The paper lid according to claim 1, wherein the tab is formed at substantially a center in a cross direction orthogonal to the paper grain direction.

8. A storage container comprising:

the paper lid according to claim 1; and a container body having a flange portion to which the paper lid is adhered.

9. The storage container according to claim 8, wherein the flange portion of the container body has an adhesion area to be adhered to the tab of the paper lid, and wherein the adhesion area has opening-assist half-cut lines extending along cut lines located on both sides of the tab.

10. The storage container according to claim 9, wherein the opening-assist half-cut lines include first opening-assist half-cut lines that are substantially coincident with the cut lines, and second and third opening-assist half-cut lines extending parallel to the first opening-assist half-cut lines and located on an inner side and an outer side of the first opening-assist half-cut lines.

11. A paper lid with a back surface capable of being adhered to a flange portion of a container body capable of storing a predetermined content, the paper lid comprising:

a tab provided on one end side of the paper lid in a paper grain direction;

first back half-cut lines for opening that extend from the tab outward and away from each other at an acute angle with respect to the paper grain direction;

second back half-cut lines for opening that extend from outer ends of the first back half-cut lines for opening, respectively, along the paper grain direction;

first front half-cut lines for opening that are located on an outer side of the first back half-cut lines for opening, respectively, with a constant width between the first front and back half-cut lines and extend along the back half-cut lines for opening, respectively, at an acute angle with respect to the paper grain direction; and second front half-cut lines for opening that are located on an outer side of the second back half-cut lines for opening, respectively, with a constant width between the second front and back half-cut lines and extend along the back half-cut lines for opening and the paper grain direction;

said paper lid further comprising:

cut lines provided on both sides of the tab and extending toward a center of the paper lid;

opening-confirmation back half-cut lines extending further from center-side ends of the cut lines, respectively, wherein the first back half-cut lines for opening extend outward from center-side ends of the opening-confirmation back half-cut lines, respectively; and spare cut lines extending along the paper grain direction on outer sides of the cut lines, respectively.

12. A storage container comprising:

a container body capable of storing a predetermined content, and a paper lid with a back surface capable of being adhered to a flange portion of the container body;

said container body having a flange portion to which the paper lid is adhered to;

the paper lid comprising:

a tab provided on one end side of the paper lid in a paper grain direction;

first back half-cut lines for opening that extend from the tab outward and away from each other at an acute angle with respect to the paper grain direction;

second back half-cut lines for opening that extend from outer ends of the first back half-cut lines for opening, respectively, along the paper grain direction;

first front half-cut lines for opening that are located on an outer side of the first back half-cut lines for opening, respectively, with a constant width between the first front and back half-cut lines and extend along the back half-cut lines for opening, respectively, at an acute angle with respect to the paper grain direction; and second front half-cut lines for opening that are located on an outer side of the second back half-cut lines for opening, respectively, with a constant width between the second front and back half-cut lines and extend along the back half-cut lines for opening and the paper grain direction;

wherein the flange portion of e container body has an adhesion area to be adhered to the tab of the paper lid, and wherein the adhesion area has opening-assist half-cut lines extending along cut lines located on both sides of the tab.

13. The storage container according to claim 12, wherein the opening-assist half-cut lines include first opening-assist half-cut lines that are substantially coincident with the cut lines, and second and third opening-assist half-cut lines extending parallel to the first opening-assist half-cut lines and located on an inner side and an outer side of the first opening-assist half-cut lines.

* * * * *